US009111488B2

(12) United States Patent
Kwak

(10) Patent No.: US 9,111,488 B2
(45) Date of Patent: Aug. 18, 2015

(54) ORGANIC LIGHT EMITTING DIODE DISPLAY DEVICE AND METHOD OF DRIVING THE SAME

(71) Applicant: LG DISPLAY CO., LTD., Seoul (KR)

(72) Inventor: Sanghyeon Kwak, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 137 days.

(21) Appl. No.: 13/858,709

(22) Filed: Apr. 8, 2013

(65) Prior Publication Data

US 2014/0145917 A1 May 29, 2014

(30) Foreign Application Priority Data

Nov. 27, 2012 (KR) ..... 10-2012-0135013

(51) Int. Cl.
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2310/0256* (2013.01); *G09G 2320/0233* (2013.01); *G09G 2320/045* (2013.01)

(58) Field of Classification Search
CPC ..... G09G 3/3233; G09G 2300/0819; G09G 2320/0233; G09G 2300/0861; G09G 2320/045; G09G 2300/0842; G09G 2310/0256
USPC ..... 345/76–77
See application file for complete search history.

(56) References Cited

U.S. PATENT DOCUMENTS

| | | | | |
|---|---|---|---|---|
| 2008/0150846 | A1* | 6/2008 | Chung | 345/76 |
| 2008/0169754 | A1 | 7/2008 | Yang et al. | |
| 2010/0194716 | A1* | 8/2010 | Park | 345/204 |
| 2010/0253666 | A1 | 10/2010 | Yamamoto | |
| 2012/0105427 | A1 | 5/2012 | Senda | |
| 2012/0120042 | A1* | 5/2012 | Tsai et al. | 345/76 |

FOREIGN PATENT DOCUMENTS

WO WO 2006/013539 A1 2/2006

* cited by examiner

*Primary Examiner* — Allison Johnson
(74) *Attorney, Agent, or Firm* — Birch, Stewart, Kolasch & Birch, LLP

(57) ABSTRACT

Discussed is an OLED display device that can compensate for the deviation of a threshold voltage and also prevent deterioration of an OLED, and a method of driving the same, wherein the OLED display device includes first to fifth transistors, a driving transistor including gate, source and drain electrodes, a capacitor for sensing a threshold voltage of the driving transistor, and an OLED.

8 Claims, 8 Drawing Sheets

ORGANIC LIGHT EMITTING DIODE DISPLAY DEVICE AND METHOD OF DRIVING THE SAME

CROSS REFERENCE TO RELATED APPLICATIONS

This application claims the benefit of the Korean Patent Application No. 10-2012-0135013 filed on Nov. 27, 2012, which is hereby incorporated by reference as if fully set forth herein.

BACKGROUND

1. Field of the Disclosure

Embodiments of the present invention relate to a display device, and more particularly, to an organic light emitting diode (OLED) display device and a method of driving the same.

2. Discussion of the Related Art

With the advancement of an information-oriented society, various requirements for the display field are increasing, and thus, research is being conducted on various flat panel display devices that are thin, light, and have low power consumption. For example, the flat panel display devices are often categorized into liquid crystal display (LCD) devices, plasma display panel (PDP) devices, OLED display devices, etc.

Particularly, some of the OLED display devices that are being actively studied apply data voltage Vdata having various levels to respective pixels in order to display different grayscale levels, thereby realizing an image.

To this end, each of a plurality of pixels may include one or more capacitors, an OLED, and a driving transistor that are current control elements. Particularly, a current flowing in the OLED may be controlled by the driving transistor, and the amount of current flowing in the OLED may be changed by a threshold voltage deviation of the driving transistor and various parameters, causing non-uniformity in screen luminance.

However, the threshold voltage deviation of the driving transistor can occur because the characteristic of the driving transistor changes due to a variable manufacturing process used for the driving transistor. To overcome this limitation, each pixel may generally include a compensation circuit that includes a plurality of transistors and capacitors for compensating for the threshold voltage deviation.

Recently, as consumers' requirements for high definition has increased, a high-resolution OLED display device has been demanded. To this end, it is generally necessary to integrate more pixels into a unit area for higher resolution, and thus, it is typically required to reduce the numbers of capacitors and lines included in the compensation circuit that compensates for the threshold voltage deviation.

Moreover, it spends a lot of time in discharging charges from the OLED during a period when the OLED does not emit light. Thus, if the OLED display device is used for a long time, the OLED may be deteriorated.

SUMMARY

Accordingly, embodiments of the present invention are directed to an OLED display device and a method of driving the same that substantially obviate one or more problems due to limitations and disadvantages of the related art.

An aspect of embodiments of the present invention is directed to provide an OLED display device that can compensate for the deviation of a threshold voltage and also prevent deterioration of an OLED, and a method of driving the same.

Additional advantages and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, there is provided an OLED display device that may include a first transistor configured to supply a data voltage to a first node according to a scan signal; a second transistor connected to the first node and a second node supplied with a high-level source voltage, and configured to connect the first node and the second node to each other according to a first control signal; a driving transistor having a gate electrode connected to a third node, a source electrode connected to the second node, and a drain electrode connected to a fourth node; a capacitor connected between the first node and the third node, and configured to sense a threshold voltage of the driving transistor; a third transistor configured to connect the third node and the fourth node to each other according to a second control signal; a fourth transistor connected to the fourth node and a fifth node, and configured to connect the fourth node and the fifth node to each other according to the first control signal; an OLED connected to the fifth node; and a fifth transistor configured to supply an initialization voltage to the fifth node according to the second control signal.

In another aspect of an embodiment of the present invention, there is provided a method of driving an OLED display device, including first to fifth transistors, a driving transistor, a capacitor, and an OLED, that may include performing an operation in which, while the second to fifth transistors are turned on and the first transistor is turned off, a second node corresponding to a source electrode of the driving transistor is connected to a first node corresponding to one end of the capacitor, a third node corresponding to the other end of the capacitor and also simultaneously corresponding to a gate electrode of the driving transistor is connected to a fourth node corresponding to a drain electrode of the driving transistor, the fourth node is connected to a fifth node corresponding to an anode electrode of the OLED, and an initialization voltage supplied to the fifth transistor is applied to the fifth node; performing an operation in which, while the first, third and fifth transistors are turned on and the second and fourth transistors are turned off, a data voltage supplied to the first transistor is applied to the first node, the initialization voltage is applied to the fifth node, and the third and fourth nodes are connected to each other; and performing an operation in which, while the second and fourth transistors are turned on and the first, third and fifth transistors are turned off, the first and second nodes are connected to each other, and the fourth and fifth nodes are connected to each other.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, embodiments of the present invention will be described in detail with reference to the accompanying drawings.

Figure 1:
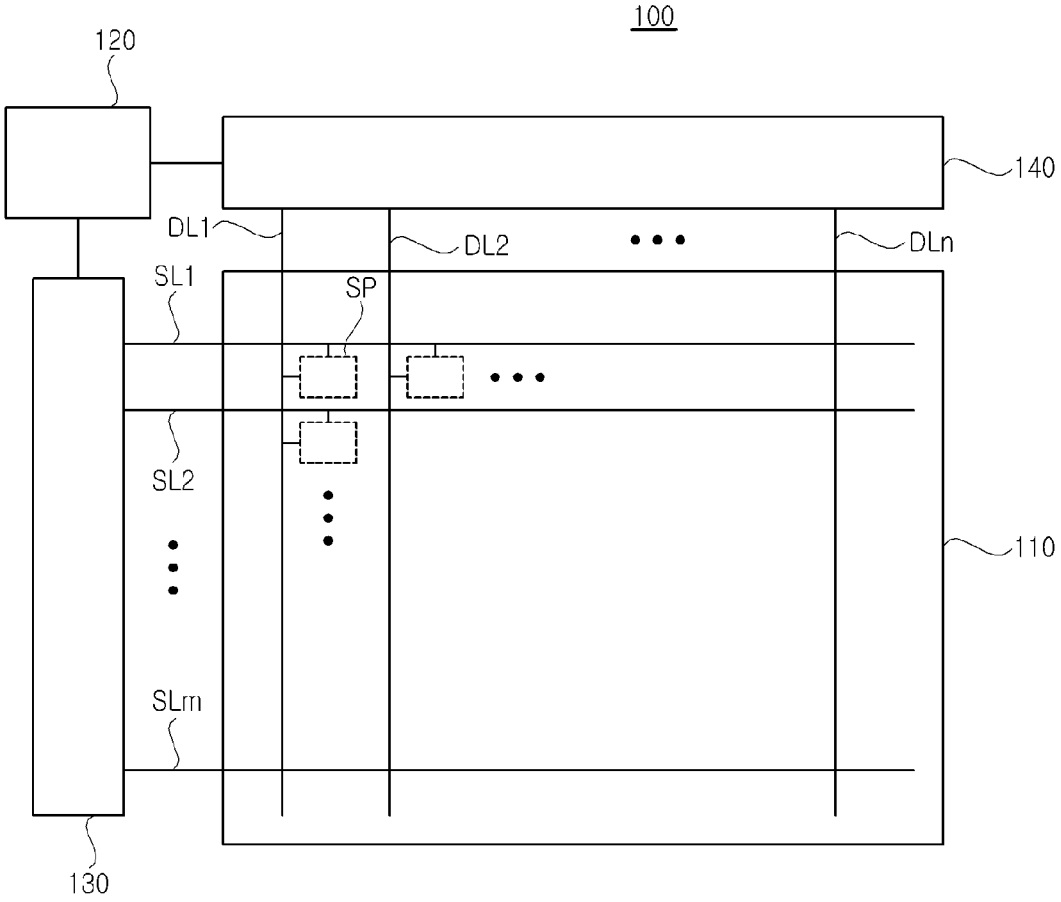
FIG. 1 is a diagram schematically illustrating an exemplary configuration of an OLED display device according to embodiments of the present invention.

FIG. 1 is a diagram schematically illustrating a configuration of an OLED display device according to embodiments of the present invention.

As illustrated in FIG. 1, an OLED display device 100 according to embodiments of the present invention may include a panel 110, a timing controller 120, a scan driver 130, and a data driver 140.

The panel 110 may include a plurality of sub-pixels SP that are arranged in a matrix type. The sub-pixels SP included in the panel 110 may emit light according to respective scan signals which are supplied through a plurality of scan lines SL1 to SLm from the scan driver 130 and respective data signals that are supplied through a plurality of data lines DL1 to DLn from the data driver 140. Also, a light emission of the sub-pixels SP may be controlled according to respective first control signals which are supplied through a plurality of first control lines (not shown) from the scan driver 130 and respective second control signals which are supplied through a plurality of second control lines (not shown) from the scan driver 130 as well as the scan signals SL1 to SLm and data signals DL1 to DLn.

To this end, one sub-pixel may include an OLED, and a plurality of transistors and capacitors for driving the OLED. The detailed configuration of each of the sub-pixels SP will be described in detail with reference to FIG. 2.

The timing controller 120 may receive a vertical sync signal Vsync, a horizontal sync signal Hsync, a data enable signal DE, a clock signal CLK, and video signals from the outside. Also, the timing controller 120 may align external input video signals to digital image data RGB in units of a frame.

For example, the timing controller 120 controls the operational timing of each of the scan driver 130 and the data driver 140 with a timing signal that includes the vertical sync signal Vsync, the horizontal sync signal Hsync, the data enable signal DE, and the clock signal CLK. To this end, the timing controller 120 generates a gate control signal GCS for controlling the operational timing of the scan driver 130 and a data control signal DCS for controlling the operational timing of the data driver 140.

The scan driver 130 may generate a scan signal "Scan" that enables the operations of transistors included in each of the sub-pixels SP in the panel 110, according to the gate control signal GCS supplied from the timing controller 120, and may supply the scan signal "Scan" to the panel 110 through the scan lines SL. Also, the scan driver 130 may generate first and second control signals "Em" and "H" as a kind of a scan signal, and may supply the respective first and second control signals "Em" and "H" to the panel 110 through a plurality of first and second control lines (not shown).

The data driver 140 may generate data signals with the digital image data RGB and the data control signal DCS that are supplied from the timing controller 120, and may supply the generated data signals to the panel 110 through the respective data lines DL.

Hereinafter, the detailed configuration of each sub-pixel will be described in detail with reference to FIGS. 1 and 2.

Figure 2:
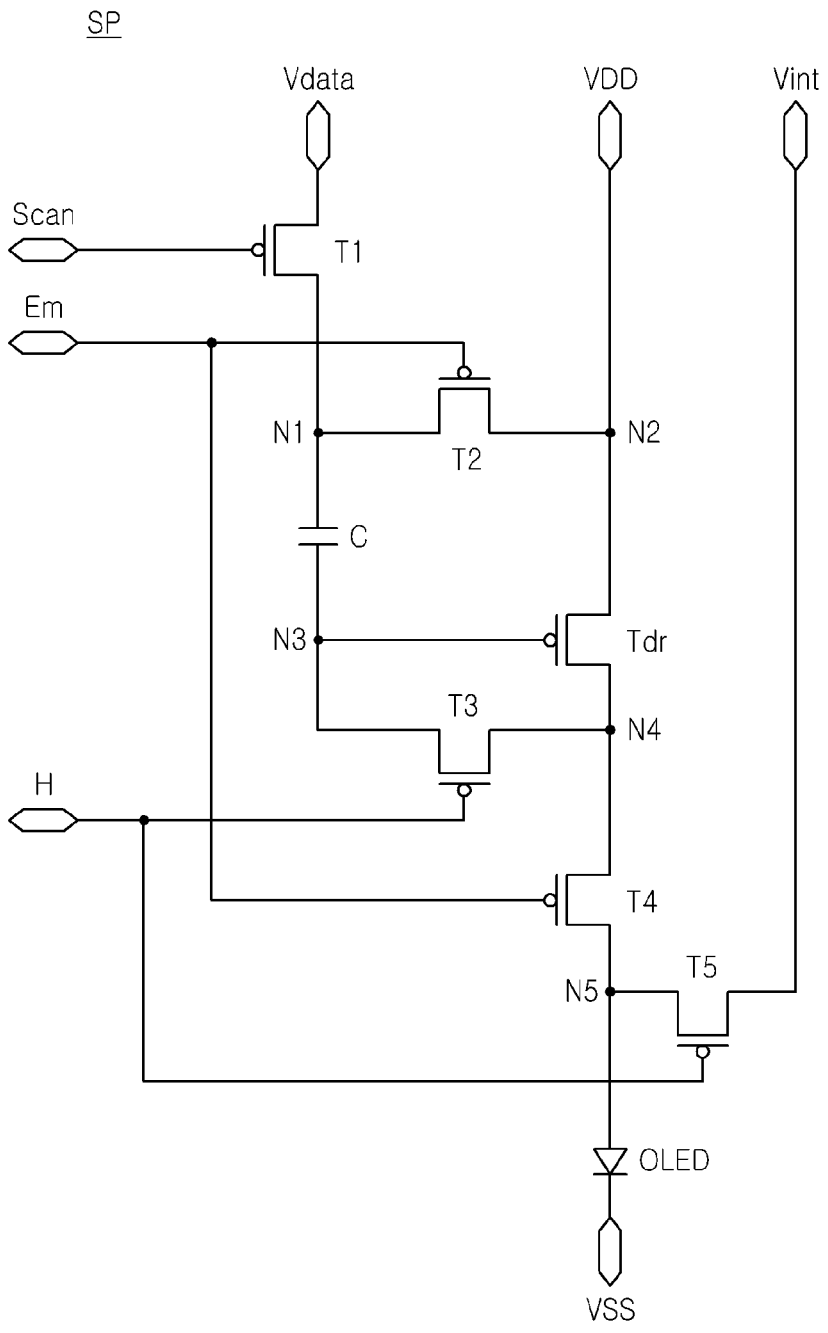
FIG. 2 is a diagram schematically illustrating an equivalent circuit of a sub-pixel of FIG. 1.

FIG. 2 is a diagram schematically illustrating an exemplary equivalent circuit of a sub-pixel of FIG. 1.

As illustrated in FIG. 2, each sub-pixel SP may include first to fifth transistors T1 to T5, a driving transistor Tdr, a capacitor C, and an organic light-emitting diode OLED.

The first to fifth transistors T1 to T5 and the driving transistor Tdr, as illustrated in FIG. 2, may be PMOS transistors, but are not limited thereto. As another example, an NMOS transistor may be applied thereto, in which case a voltage for turning on the PMOS transistor has a polarity opposite to that of a voltage for turning on the NMOS transistor.

First, a data voltage Vdata is applied to a source electrode of the first transistor T1, a scan signal Scan is applied to a gate electrode of the first transistor T1, and a drain electrode of the first transistor T1 is connected to a first node N1 corresponding to one end of the capacitor C.

For example, the data voltage Vdata may be applied to the source electrode of the first transistor T1 through a data line DL, and an operation of the first transistor T1 may be controlled according to the scan signal Scan supplied through a scan line SL.

Therefore, the first transistor T1 may be turned on according to the scan signal Scan, and supply the data voltage Vdata to the first node N1.

Herein, the data voltage Vdata may be a successive voltage that is changed in units of one horizontal period (1H). For example, when an n−1th data voltage Vdata[n−1] is applied to the source electrode of the first transistor T1 during one horizontal period 1H, an nth data voltage Vdata[n] is applied thereto during the next one horizontal period 1H. Then, a next data voltage may be successively applied thereto every one horizontal period 1H.

Thereafter, a high-level source voltage VDD is applied to a second node N2 corresponding to a source electrode of the second transistor T2, a first control signal Em is applied to a gate electrode of the second transistor T2, and a drain electrode of the second transistor T2 is connected to the first node N1.

For example, when the high-level source voltage VDD is applied to the second node N2 and the second transistor T2 is turned on according to the first control signal Em supplied through a first control line, the first node N1 and second node N2 are connected to each other, whereby the high-level source voltage VDD may be applied to the first node N1.

Next, the capacitor C is connected between the first node N1 and a third node N3 corresponding to a gate electrode of the driving transistor Tdr.

For example, the capacitor C senses a threshold voltage Vth of the driving transistor Tdr. In more detail, the voltage equal to the difference between the data voltage Vdata and the sum "VDD+Vth" of the high-level source voltage VDD and the threshold voltage Vth of the driving transistor Tdr may be stored in the capacitor C.

Then, a second control signal H is applied to a gate electrode of the third transistor T3, a source electrode of the third transistor T3 is connected to the third node N3, and a drain electrode of the third transistor T3 is connected to a fourth node N4 corresponding to a source electrode of the fourth transistor T4.

For example, when the third transistor T3 is turned on according to the second control signal H supplied through a second control line, the third node N3 and fourth node N4 may be connected to each other.

Then, the gate electrode of the driving transistor Tdr is connected to the third node N3, a source electrode thereof is connected to the second node N2, and a drain electrode thereof is connected to the fourth node N4.

Meanwhile, the amount of a current flowing in the OLED to be described may be determined by the sum "Vgs+Vth" of voltage Vgs between the source and gate electrodes of the driving transistor Tdr and the threshold voltage Vth of the driving transistor Tdr, and may be finally determined by a compensation circuit with the data voltage Vdata and the high-level source voltage VDD.

Therefore, the amount of current flowing in the OLED may be proportional to the level of the data voltage Vdata. Accordingly, the OLED display device according to embodiments of the present invention may apply the various levels of data voltage Vdata to the respective sub-pixels SP in order to realize different gray scales, thereby displaying an image.

Next, the first control signal Em is applied to a gate electrode of the fourth transistor T4, a source electrode of the fourth transistor T4 is connected to the fourth node N4, and a drain electrode of the fourth transistor T4 is connected to a fifth node N5 corresponding to an anode electrode of the OLED.

For example, when the fourth transistor T4 is turned on according to the first control signal Em supplied through the first control line, the fourth node N4 and fifth node N5 are connected to each other, whereby a light emission of the OLED may be controlled.

If the fourth transistor T4 is turned off, the light emission of OLED is turned off. When the fourth transistor T4 is turned on, the light emission of OLED may be controlled by an initialization voltage applied to the fifth node N5, which will be described below.

Then, the initialization voltage Vint is applied to a source electrode of the fifth transistor T5, the second control signal H is applied to a gate electrode of the fifth transistor T5, and a drain electrode of the fifth transistor T5 is connected to the fifth node N5.

For example, when the fifth transistor T5 is turned on according to the second control signal H supplied through the second control line, the initialization voltage Vint may be applied to the fifth node N5.

In other words, if the second control signal H is a low level voltage, the fifth transistor T5 is turned on, whereby the initialization voltage Vint may be applied to the fifth node N5.

In this case, the initialization voltage Vint may be lower than the threshold voltage of the OLED. Thus, if the initialization voltage Vint is applied to the fifth node N5 corresponding to the anode electrode of the OLED, the light emission of the OLED is turned off. That is, it is possible to prevent deterioration of the OLED even though the OLED display device is used for a long time.

Thereafter, the anode electrode of the OLED is connected to the fifth node N5, and a low-level source voltage VSS is applied to a cathode electrode of the OLED.

Hereinafter, the operation of each sub-pixel included in the OLED display device according to embodiments of the present invention will be described in detail with reference to FIGS. 3 and 5A to 5C.

Figure 3:
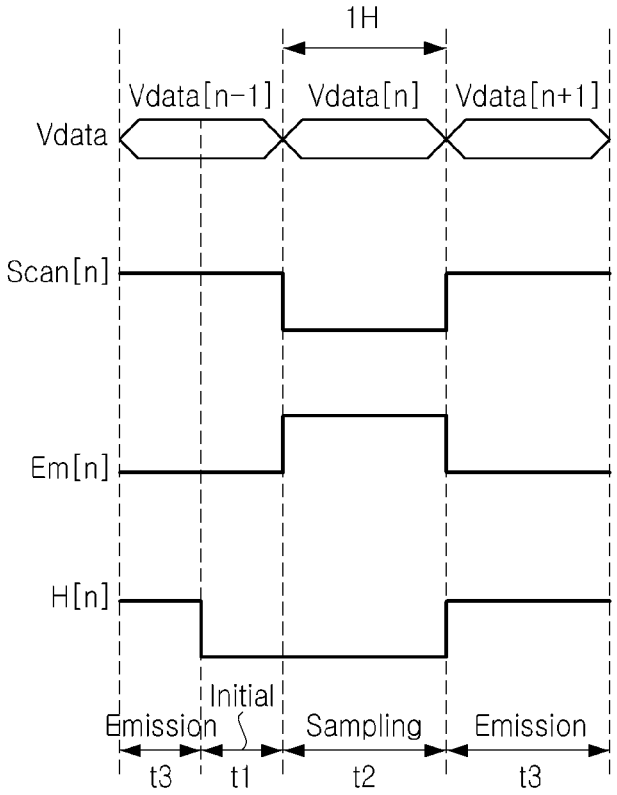
FIG. 3 is a timing chart for control signals supplied to the equivalent circuit of FIG. 2.
Figure 5A:
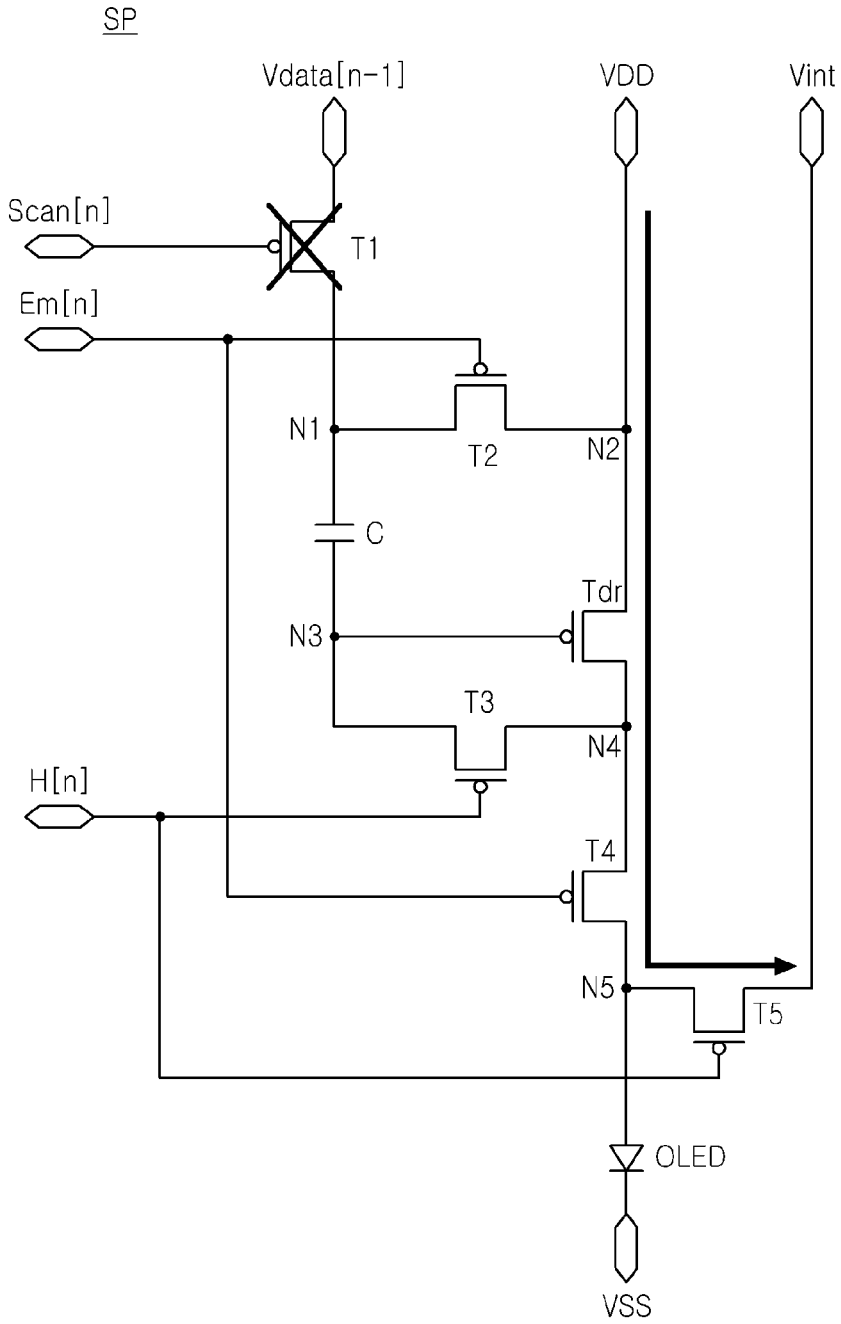
FIGS. 5A to 5C are diagrams for describing an exemplary method of driving an OLED display device according to embodiments of the present invention.
Figure 5B:
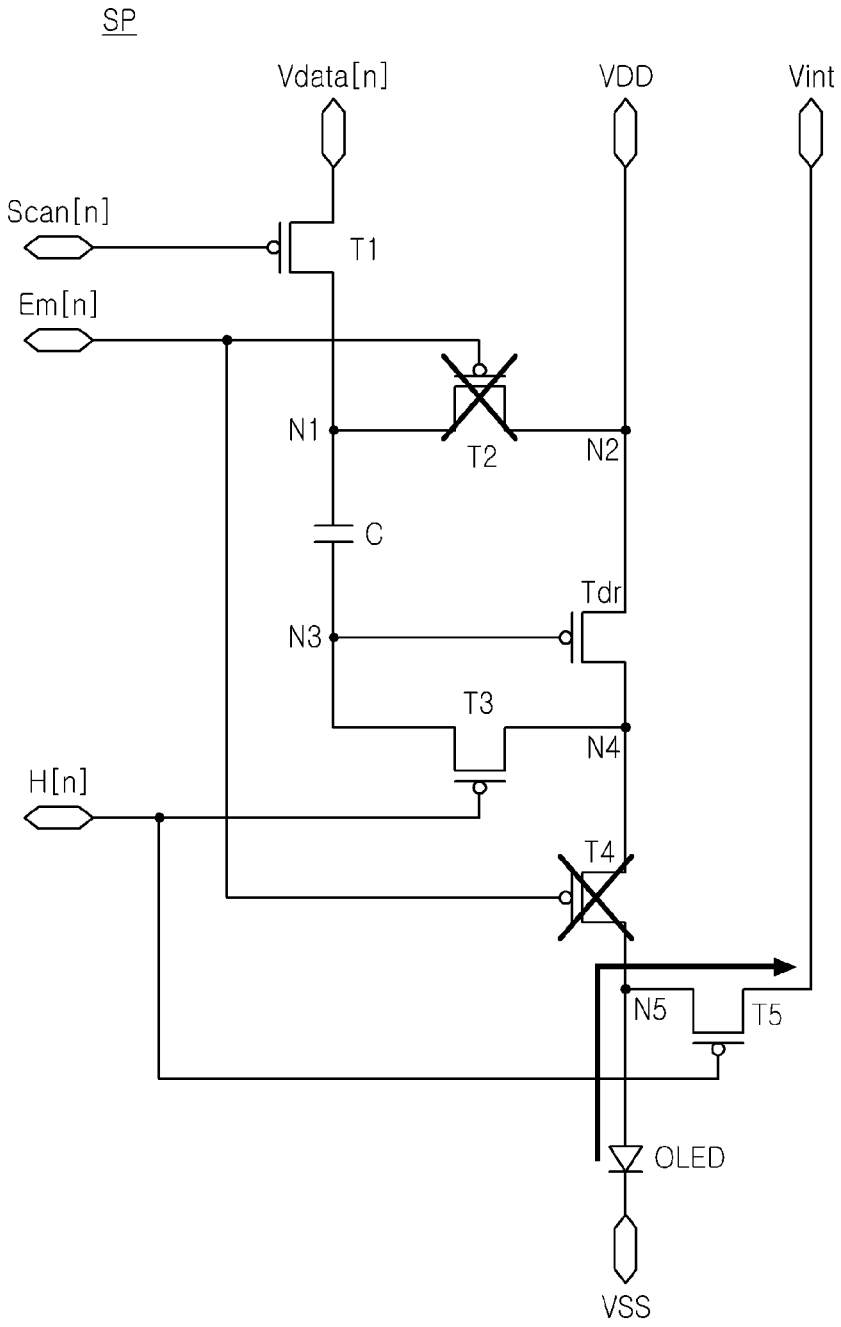
Figure 5C:
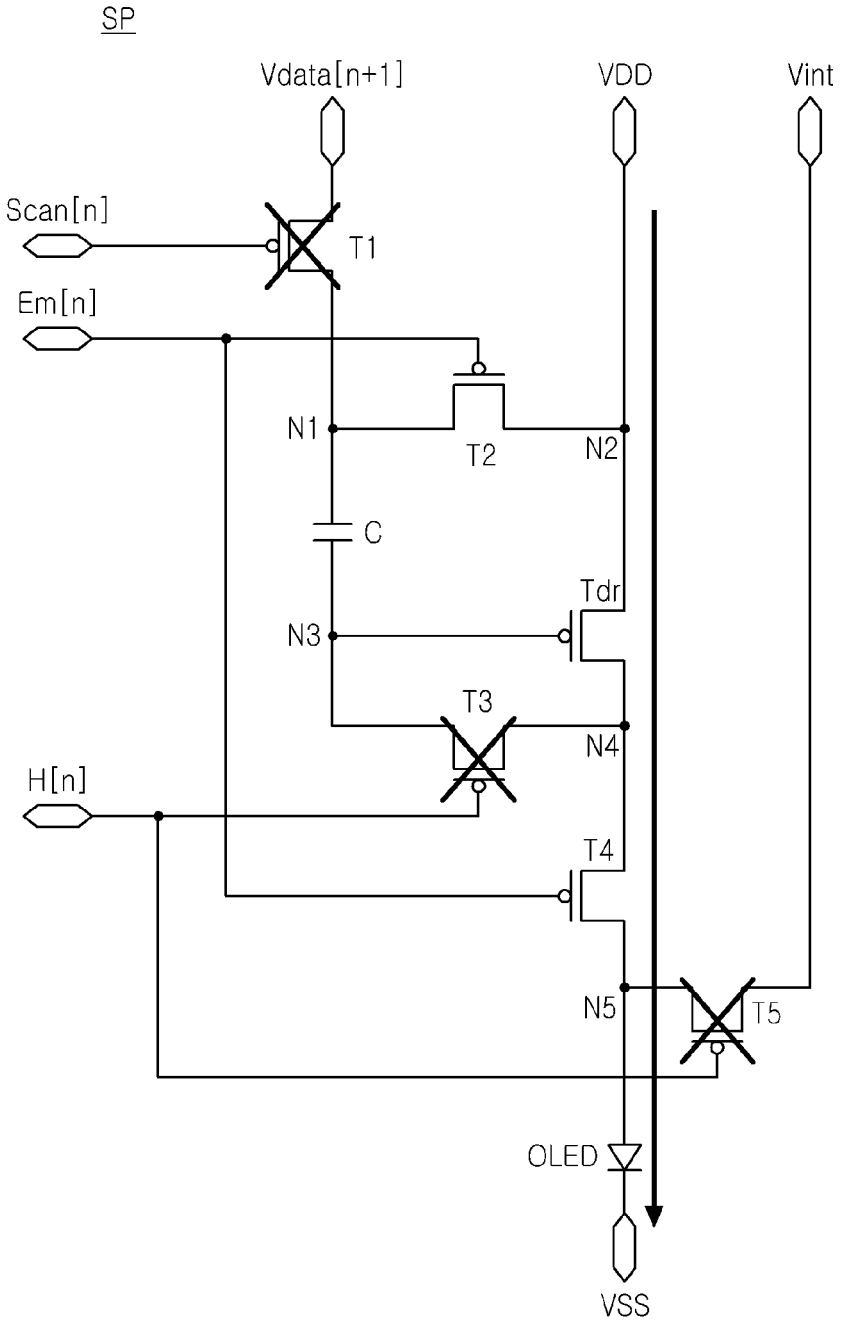

FIG. 3 is a timing chart for control signals that may be supplied to the equivalent circuit of FIG. 2. FIGS. 5A to 5C are diagrams for describing a method of driving the OLED display device according to embodiments of the present invention.

As shown in FIG. 3, the OLED display device according to embodiments of the present invention may operate during an initialization period t1, a sampling period t2, and an emission period t3.

First, as shown in FIG. 3, during the initialization period t1, a high-level scan signal Scan[n] and low-level first and second control signals Em[n] and H[n] may be applied to a sub-pixel.

Therefore, as illustrated in FIG. 5A, the first transistor T1 may be turned off by the high-level scan signal Scan [n], the second transistor and fourth transistor T2 and T4 are turned on by the low-level first control signal Em[n], and the third transistor and fifth transistor T3 and T5 are turned on by the low-level second control signal H[n].

Also, the n−1th data voltage Vdata[n−1] is applied to the source electrode of the first transistor T1 through a data line, however, the first transistor T1 is turned off. Thus, the n−1th data voltage Vdata[n−1] is not supplied to the first node N1.

According as the fifth transistor T1 is turned on, the initialization voltage Vint applied to the source electrode of the fifth transistor T5 is applied to the fifth node N5, whereby the light emission of the OLED is turned off.

As a result, during the initialization period t1, the first node N1 is connected to the second node N2, the third node N3 is connected to the fourth node N4, the fourth node N4 is connected to the fifth node N5, and the initialization voltage Vint is applied to the fifth node N5 corresponding to the anode electrode of the OLED.

For example, during the initialization period t1, the first node N1 is connected to the second node N2, the fourth node N4 is connected to the fifth node N5, and the initialization voltage Vint is applied to the fifth node N5. Thus, as a current path is formed between a terminal applied with the high-level source voltage VDD and a terminal applied with the initialization voltage Vint, the light emission of the OLED may be turned off. In this case, the initialization voltage Vint applied to the fifth node N5 corresponding to the anode electrode of the OLED has to be lower than the threshold voltage of the OLED in order to turn off the light emission of the OLED.

This is to ensure that the OLED is completely turned off during the other periods except the emission period, to thereby prevent deterioration of the OLED.

Then, during the sampling period t2, as shown in FIG. 3, a low-level scan signal Scan[n], a low-level second control signal H[n], and a high-level first control signal Em[n] are applied to a sub-pixel.

Therefore, as illustrated in FIG. 5B, the first transistor T1 is turned on by the low-level scan signal Scan[n], the second transistor and fourth transistor T2 and T4 are turned off by the high-level first control signal Em[n], and the third transistor and fifth transistor T3 and T5 are turned on by the low-level second control signal H[n].

Also, the nth data voltage Vdata[n] is applied to the source electrode of the first transistor T1 through a data line, and the first transistor T1 is turned on, whereby the nth data voltage Vdata[n] is applied to the first node N1.

According as the second transistor and fourth transistor T2 and T4 are turned off, the first node N1 and second node N2 are disconnected from each other, and the fourth node N4 and fifth node N5 are disconnected from each other. Also, according as the third transistor T3 is turned on, the third node N3 and fourth node N4 are connected to each other.

Thus, the high-level source voltage VDD is applied to the second node N2 corresponding to a source electrode of the driving transistor Tdr, the nth data voltage Vdata[n] is applied to the first node N1 corresponding to one end of the capacitor C, and the voltage of the third node N3 corresponding to the gate electrode of the driving transistor Tdr may be the sum "VDD+Vth" of the high-level source voltage VDD and the threshold voltage Vth of the driving transistor Tdr.

Accordingly, during the sampling period t2, both ends of the capacitor C may be charged with the voltage equal to the difference "VDD+Vth−Vdata[n]" between the third node voltage "VDD+Vth" and the nth data voltage Vdata[n]. As a result, the capacitor C senses the threshold voltage Vth of the driving transistor Tdr, and samples the data voltage Vdata.

Meanwhile, according as the fifth transistor T5 maintains a turn-on state, the initialization voltage Vint is continuously applied to the fifth node N5, whereby the light emission of the OLED is maintained as a turn-off state.

The OLED included in the OLED display device according to embodiments of the present invention may start to emit light right after sampling of each scan line is completed for each frame.

In other words, an operation in which the light emission is started right after sampling of each scan line is completed will be described below in more detail with reference to FIG. 4.

Figure 4:
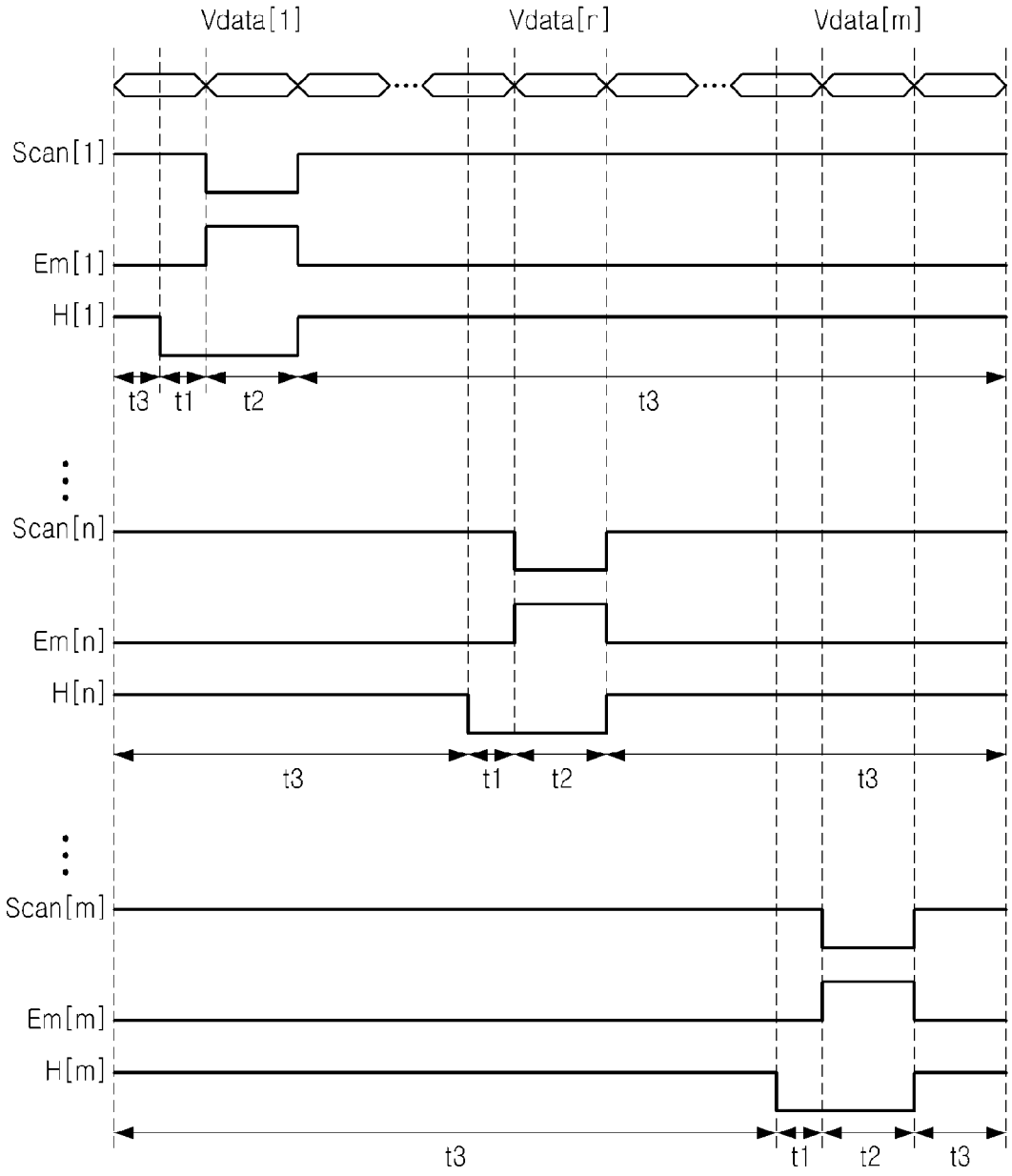
FIG. 4 is a timing chart showing in detail the timing chart of FIG. 3.

FIG. 4 is a timing chart showing in detail the timing chart of FIG. 3. In the OLED display device according to embodiments of the present invention, when it is assumed that there are an 'm' number of scan lines, scan signals Scan[1], Scan[n] and Scan[m] may be respectively applied to a first scan line, an nth scan line, and an mth scan line, and first to mth data voltages Vdata[1] to Vdata[m] may be applied to one data line intersecting each scan line.

Here, a scan period for which a plurality of data voltages are applied to respective sub-pixels may include an initialization period t1, a sampling period t2, and an emission period t3 for each scan line.

Thus, the OLED starts to emit light right after sampling of corresponding data voltage for each scan line is completed.

Subsequently, as shown in FIG. 3, during the emission period t3, a high-level scan signal Scan[n], a high-level second control signal H[n], and a low-level first control signal Em[n] may be applied to a sub-pixel.

Accordingly, as illustrated in FIG. 5C, the first transistor T1 is turned off by the high-level scan signal Scan[n], the second transistor and fourth transistor T2 and T4 are turned on by the low-level first control signal Em[n], and the third transistor and fifth transistor T3 and T5 are turned off by the high-level second control signal H[n].

Also, an n+1th data voltage Vdata[n+1] is applied to the source electrode of the first transistor T1 through a data line, however, the first transistor T1 is turned off. Thus, the n+1th data voltage Vdata[n+1] is not supplied to the first node N1.

When the fifth transistor T3 is turned off and thus the third node N3 is disconnected from the fourth node N4, the second node N2 is connected to the first node N1 according as the second transistor T2 is turned on, and the fourth node N4 is connected to the fifth node N5 according as the fourth transistor T4 is turned on.

Accordingly, the high-level source voltage VDD is applied to the second node N2 corresponding to the source electrode of the driving transistor Tdr, and the voltage of the third node N3 corresponding to the gate electrode of the driving transistor Tdr may be the voltage "VDD+Vth−Vdata[n]+VDD" equal to the sum of the voltage "VDD+Vth−Vdata[n]" stored in the capacitor C during the sampling period t2 and the high-level source voltage VDD.

Eventually, during the emission period t3, the fourth transistor T4 is turned on, and the initialization voltage is not applied to the fifth node N5, whereby the OLED starts to emit light.

Accordingly, the current Ioled flowing in the OLED may be determined by a current flowing in the driving transistor Tdr, and the current flowing in the driving transistor Tdr may be determined by the voltage Vgs between the gate and source electrodes of the driving transistor Tdr and the threshold voltage Vth of the driving transistor Tdr. The current Ioled may be defined as expressed in Equation (1).

$$\begin{aligned} Ioled &= K \times (Vgs - Vth)^2 \\ &= K \times ((VDD + Vth - Vdata[n] + VDD - VDD) - Vth)^2 \\ &= K \times (VDD - Vdata[n])^2 \end{aligned} \quad \text{Equation (1)}$$

where "K" denotes a proportional constant that is determined by the structure and physical properties of the driving transistor Tdr, and may be determined with the mobility of the driving transistor Tdr and the ratio "W/L" of the channel width "W" and length "L" of the driving transistor Tdr.

Referring to Equation (1), in the OLED display device according to embodiments of the present invention, the current Ioled flowing in the OLED may not be affected by the threshold voltage Vth of the driving transistor Tdr during the emission time t3, and may be determined by the difference between the data voltage Vdata and the high-level source voltage VDD.

Accordingly, the OLED display device according to embodiments of the present invention may compensate for the deviation of the threshold voltage according to the operational state of the driving transistor Tdr, and thus may maintain a constant current flowing in the OLED, thereby preventing the degradation of image quality.

Figure 6:
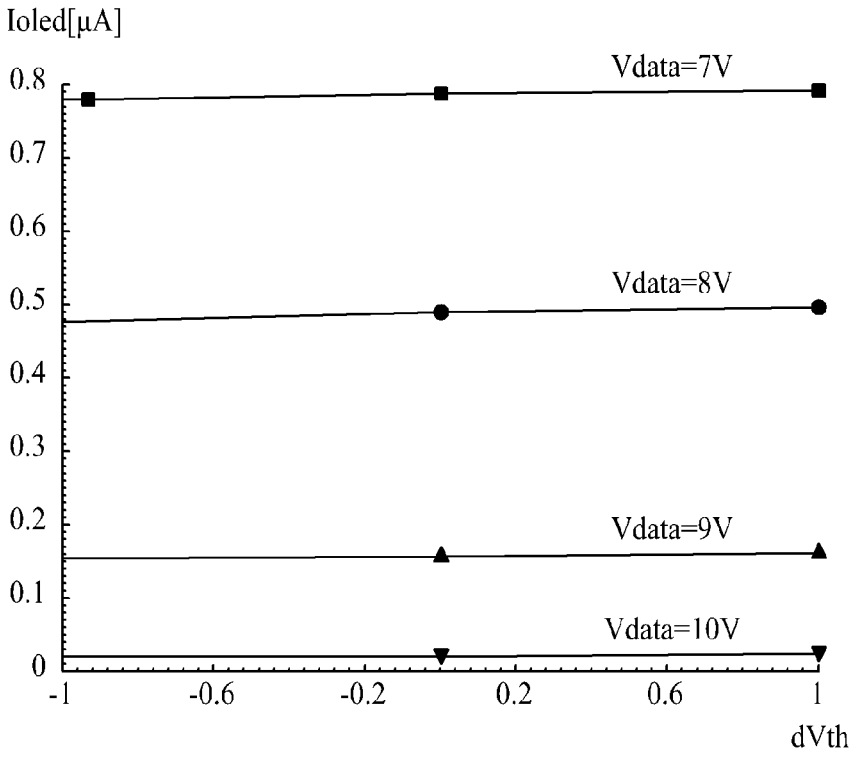
FIG. 6 is a diagram for describing the change in a current due to the threshold voltage deviation of an OLED display device according to embodiments of the present invention.

FIG. 6 is a diagram for describing the change in a current due to the threshold voltage deviation of an OLED display device according to embodiments of the present invention.

As show in FIG. 6, it can be seen that the level of the current Ioled flowing in the OLED is proportional to the data voltage Vdata, but the constant level of the current Ioled is maintained under the same data voltage Vdata regardless of the deviation dVth of the threshold voltage Vth.

According to embodiments of the present invention, the OLED display device may compensate for the deviation of the threshold voltage according to the operational state of the driving transistor Tdr, and thus may maintain a constant current flowing in the OLED, thereby preventing the degradation of image quality.

Moreover, according to embodiments of the present invention, the initialization voltage is applied to the anode electrode of the OLED during the initialization period and the sampling period, thereby preventing the deterioration of the OLED.

It will be apparent to those skilled in the art that various modifications and variations can be made to embodiments of the present invention without departing from the spirit or scope of the invention. Thus, it is intended that the present invention covers the modifications and variations of this invention provided they come within the scope of the appended claims and their equivalents.

What is claimed is:

1. An organic light emitting diode (OLED) display device, comprising:

a first transistor configured to supply a data voltage to a first node according to a scan signal;

a second transistor connected to the first node and a second node supplied with a high-level source voltage, and configured to connect the first node and the second node to each other according to a first control signal;

a driving transistor having a gate electrode connected to a third node, a source electrode connected to the second node, and a drain electrode connected to a fourth node;

a capacitor connected between the first node and the third node, and configured to sense a threshold voltage of the driving transistor;

a third transistor configured to connect the third node and the fourth node to each other according to a second control signal;

a fourth transistor connected to the fourth node and a fifth node, and configured to connect the fourth node and the fifth node to each other according to the first control signal;

an OLED connected to the fifth node; and a fifth transistor configured to supply an initialization voltage to the fifth node according to the second control signal, wherein a light emission of the OLED is controlled according to a difference voltage between the high-level source voltage and the data voltage, and wherein, when the second to fifth transistors are turned on and the first transistor is turned off, the initialization voltage is applied to the fifth node, the first and second nodes are connected to each other, the fourth and fifth nodes are connected to each other, and the third and fourth nodes are connected to each other.

2. The OLED display device of claim 1, wherein the first transistor is turned on by the scan signal applied through a scan line, the second and fourth transistors are turned on by the first control signal applied through a first control line, and the third and fifth transistors are turned on by the second control signal applied through a second control line.

3. The OLED display device of claim 1, wherein the second control signal is supplied to a gate electrode of the fifth transistor, and the initialization voltage is supplied to a source electrode of the fifth transistor.

4. The OLED display device of claim 1, wherein, when the first, third and fifth transistors are turned on and the second and fourth transistors are turned off, the data voltage is applied to the first node, the initialization voltage is applied to the fifth node, and the third and fourth nodes are connected to each other.

5. The OLED display device of claim 4, wherein a voltage of the third node is a voltage equal to the sum of a high-level source voltage and the threshold voltage of the driving transistor.

6. The OLED display device of claim 4, wherein, when the second and fourth transistors are turned on and the first, third and fifth transistors are turned off, the first and second nodes are connected to each other, and the fourth and fifth nodes are connected to each other, and the OLED emits light.

7. A method of driving an organic light emitting diode (OLED) display device which includes first to fifth transistors, a driving transistor, a capacitor, and an OLED, the method comprising:

performing an operation in which, while the second to fifth transistors are turned on and the first transistor is turned off, a second node, supplied with a high-level source voltage, corresponding to a source electrode of the driving transistor is connected to a first node corresponding to one end of the capacitor, a third node corresponding to the other end of the capacitor and also simultaneously corresponding to a gate electrode of the driving transistor is connected to a fourth node corresponding to a drain electrode of the driving transistor, the fourth node is connected to a fifth node corresponding to an anode electrode of the OLED, and an initialization voltage supplied to the fifth transistor is applied to the fifth node;

performing an operation in which, while the first, third and fifth transistors are turned on and the second and fourth transistors are turned off, a data voltage supplied to the first transistor is applied to the first node, the initialization voltage is applied to the fifth node, and the third and fourth nodes are connected to each other; and performing an operation in which, while the second and fourth transistors are turned on and the first, third and fifth transistors are turned off, the first and second nodes are connected to each other, and the fourth and fifth nodes are connected to each other, and the OLED emits light according to a difference voltage between the high-level source voltage and data voltage.

8. The method according to claim 7, wherein the first transistor is turned on by a scan signal applied through a scan line, the second and fourth transistors are turned on by a first control signal applied through a first control line, and the third and fifth transistors are turned on by a second control signal applied through a second control line.

* * * * *